US005719549A

United States Patent [19]

Lai

[11] Patent Number: 5,719,549

[45] Date of Patent: Feb. 17, 1998

[54] BUZZER ASSEMBLY

[76] Inventor: Chi-Shih Lai, No. 91, Lane 259, Szu Wei Road, Panchiao, Taipei Hsien, Taiwan

[21] Appl. No.: 708,631

[22] Filed: Sep. 5, 1996

[51] Int. Cl.[6] ..... G08B 3/00

[52] U.S. Cl. ..... 340/384.73; 340/391.1; 340/692; 381/188; 381/192; 381/205

[58] Field of Search ..... 340/384.7, 384.73, 340/692, 384.1, 391.1; 381/192, 188, 205; 181/143, 199

[56] References Cited

U.S. PATENT DOCUMENTS

| | | | |
|---|---|---|---|
| 4,574,272 | 3/1986 | Brown | 340/384.73 |
| 4,973,941 | 11/1990 | Davis et al. | 340/384.7 |
| 5,606,304 | 2/1997 | Wan | 340/384.7 |

*Primary Examiner*—Thomas Mullen
*Assistant Examiner*—Daniel J. Wu
*Attorney, Agent, or Firm*—Morton J. Rosenberg; David I. Klein; Jun Y. Lee

[57] ABSTRACT

A buzzer assembly including a casing mounted with an ornament, an IC board mounted within the casing and carrying a battery and an IC, a buzzer mounted in the casing and connected to the IC, a coupling plate mounted in the casing, a top cover mounted within the casing and covered on the IC board and the buzzer and having a rubber press cone with a electric conducting element, a plurality of light emitting elements respectively connected to the IC, and a bottom cap covered on the casing at one side and coupled to the coupling plate and having a magnet on the outside adapted for securing the whole assembly to a metal surface, wherein when the ornament is depressed, the electric conducting element of the rubber press cone is forced to contact the two opposite terminals of the IC, causing the IC to turn on the buzzer and the light emitting elements.

2 Claims, 3 Drawing Sheets

BUZZER ASSEMBLY

BACKGROUND OF THE INVENTION

The present invention relates to buzzers, and relates more particularly to a buzzer assembly which is operated to produce sound simply by depressing an ornament which is mounted on the casing thereof.

Regular sound producing ornamental toys commonly use a buzzer controlled by an IC to produce sound. The power supply of the IC is provided from a battery through the control of a power switch. However, controlling the operation of the IC through a power switch is monotonous and less attractive.

SUMMARY OF THE INVENTION

According to one aspect of the present invention, the buzzer assembly comprises a casing mounted with an ornament, an IC board mounted within the casing and carrying a battery and an IC, a buzzer mounted in the casing and connected to the IC, a coupling plate mounted in the casing, a top cover mounted within the casing and covered on the IC board and the buzzer and having a rubber press cone with a electric conducting element, and a bottom cap covered on the casing at one side and coupled to the coupling plate and having a magnet on the outside adapted for securing the whole assembly to a metal surface, wherein when the ornament is depressed, the electric conducting element of the rubber press cone is forced to contact the two opposite terminals of the IC, causing the IC to turn on the buzzer and the light emitting elements. According to another aspect of the present invention, a plurality of light emitting elements, for example, light emitting diodes are respectively mounted in respective through holes in the ornament and controlled by the IC to produce a lighting effect.

DETAILED DESCRIPTION OF THE PREFERRED EMBODIMENT

Figure 1:
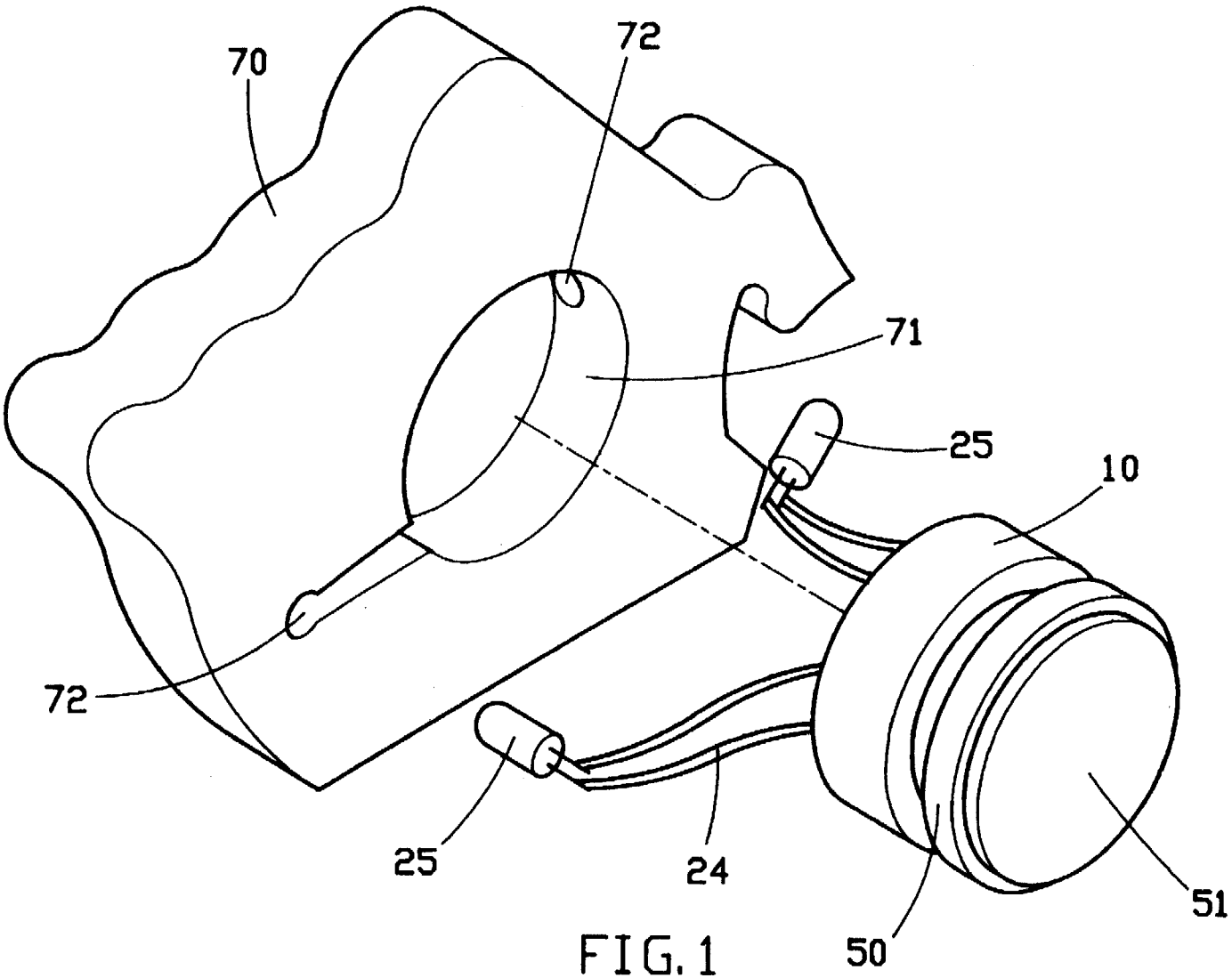
FIG. 1 is an assembly view of a buzzer assembly according to the present invention.
Figure 2:
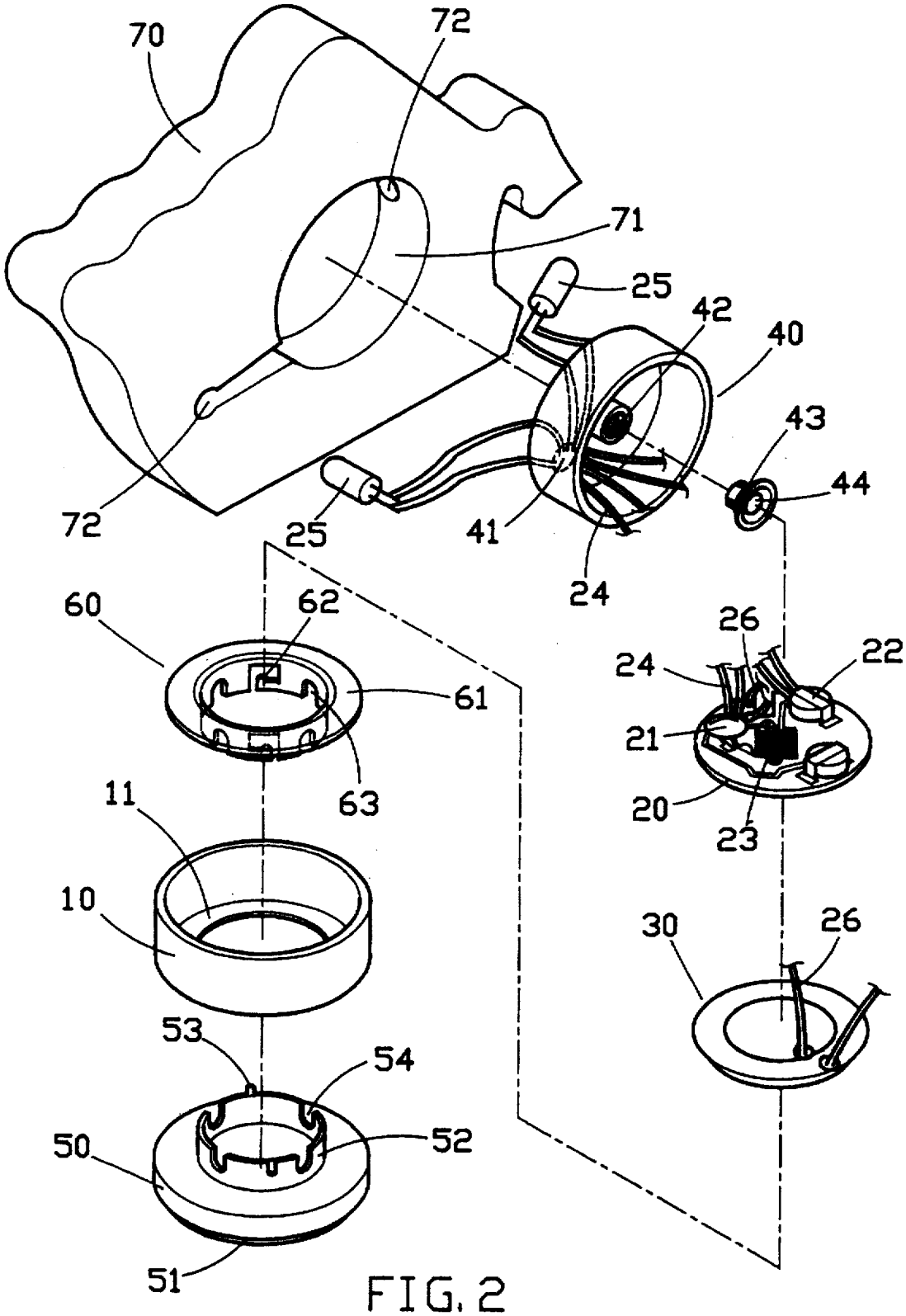
FIG. 2 is an exploded view of the buzzer assembly shown in FIG. 1.
Figure 3:
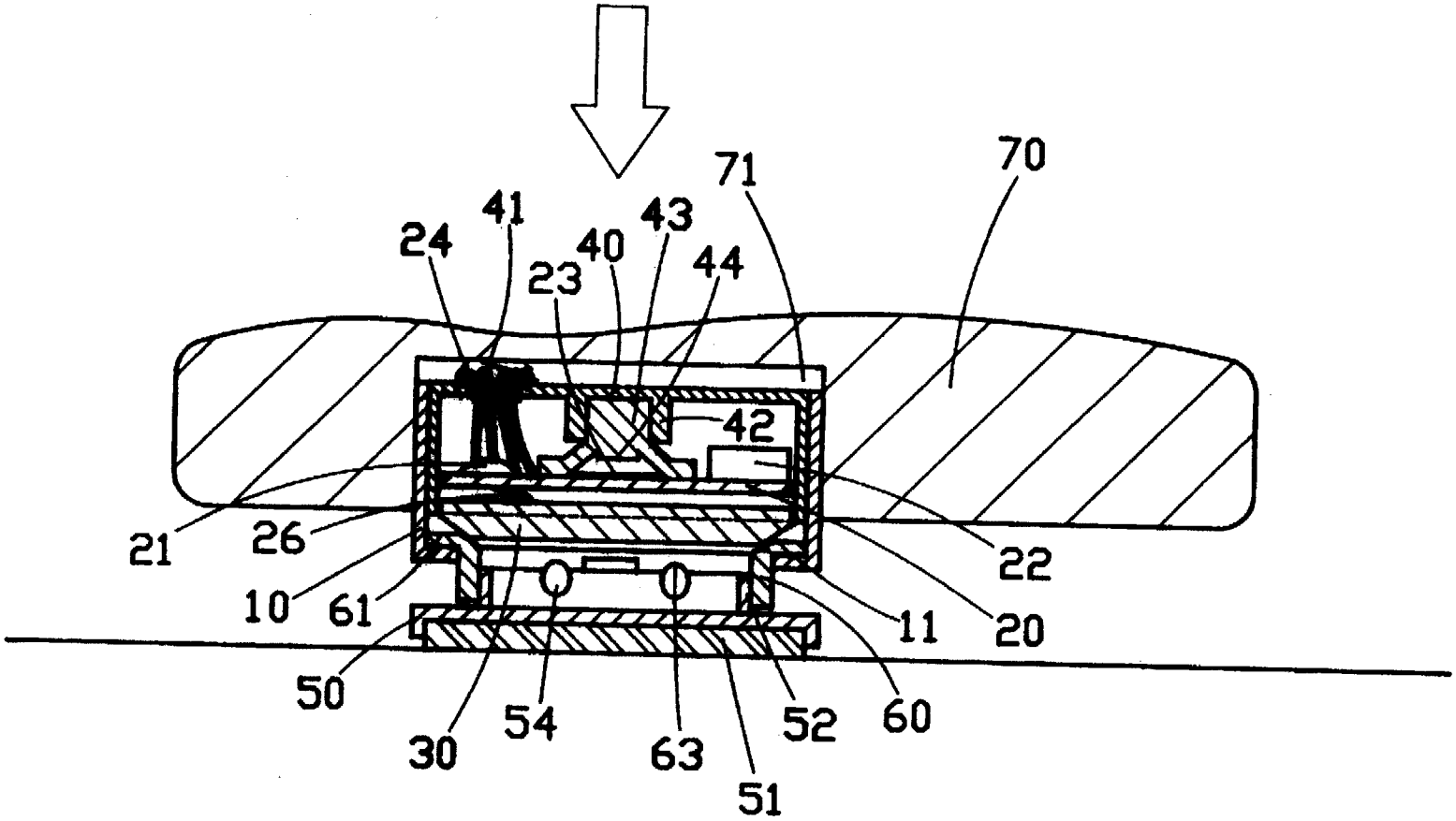
FIG. 3 is a sectional plain view of the present invention, showing the buzzer assembly installed.

Referring to FIGS. from 1 to 3, a buzzer assembly in accordance with the present invention is generally comprised of a casing 10, an IC board 20, a buzzer 30, a top cover 40, a bottom cap 50, a coupling plate 60, and an ornament 70.

The casing 10 is a hollow, double-open-ended cylindrical shell having an inward annular flange 11 at one end. The IC board 20 is mounted within the casing 10, comprising an IC 21, a battery 22 connected to the IC 11, two electric conducting elements 23 respectively connected to the positive and negative terminals of the IC 21, and a plurality of light emitting elements 25 connected to the IC 21 and the battery 22 by electric conductors 24. The buzzer 30 is mounted within the casing 10 below the IC board 20, and connected to the IC board 20 by electric conductors 26. The coupling plate 60 is mounted within the casing 10 and disposed below the buzzer 30, having an annular base 61 supported on the inward annular flange 11 of the casing 10, two opposite retaining grooves 62, and a plurality of voice output holes 63. The top cover 40 is mounted within the casing 10 and covered on the IC board 20, comprising a wire hole 41 through which the electric conductors 24 and the light emitting elements 25 pass to the outside, a locating post 42 on the inside, and a rubber press cone 43 fastened to the locating post 42. The rubber press cone 43 is fixedly mounted with an electric conducting element 44. When the top cover 40 is fastened to the casing 10, the top cover 40 and the casing 10 form an enclosed shell which holds the IC board 20, the buzzer 30, and the coupling plate 60 on the inside. When assembled, the electric conducting element 44 is suspending above the electric conducting elements 23 of the IC board 20. The bottom cap 50 is a circular cap covered on one end of the casing 10 and coupled to the coupling plate 60, having a magnet 51 at one side, and an endless upright flange 52 at an opposite side. The endless upright flange 52 is inserted into the space defined within the inward annular flange 11 of the casing 10, having two opposite retainer rods 53 respectively forced into engagement with the retaining grooves 62 of the coupling plate 60, and a plurality of voice output holes 54 matched with the voice output holes 63 of the coupling plate 60 for output of voice produced from the buzzer 30. The ornament 70 is covered on the casing 10 for decoration, having a mounting hole 71, which receives the casing 10, and a plurality of through holes 72 which receive the light emitting elements 25.

When the buzzer assembly is assembled, it can be secured to a metal surface by the magnet 51 of the bottom cap 50. When the ornament 70 is depressed, the casing 10 and the top cover 40 are moved downwards, causing the electric conducting element 44 of the rubber press cone 43 to be forced into contact with the electric conducting elements 23 of the IC board 20. When the electric conducting element 44 of the rubber press cone 43 touches the electric conducting elements 23 of the IC board 20, the IC 21 is triggered to drive the buzzer 30 and the light emitting elements 25, causing them to produce light or sound. When the pressure is released from the buzzer assembly, the rubber press cone 43 immediately returns to its former shape to disconnect the electric conducting element 44 from the electric conducting elements 23, and therefore battery power supply is cut off from the IC 21.

While only one embodiment of the present invention has been shown and described, it will be understood that various modifications and changes could be made thereunto without departing from the spirit and scope of the invention disclosed.

What the invention claimed is:

1. A buzzer assembly comprising:

a casing mounted in a mounting hole in an ornament, having an inward annular flange at one end;

an IC board mounted within said casing, having an IC, a battery adapted for providing the necessary working power supply to said IC, and two electric conducting elements respectively connected to two opposite terminals of said IC;

a buzzer mounted within said casing and connected to said IC by electric conductors;

a coupling plate mounted within said casing, said coupling plate having an annular base supported on the inward annular flange of said casing, a plurality of retaining grooves, and a plurality of voice output holes;

a top cover mounted within said casing and covered on said IC board, said top cover comprising a locating post on the inside, a rubber press cone fastened to said locating post, and an electric conducting element fixedly secured to said rubber press cone and suspending above the electric conducting elements of said IC board, the electric conducting element of said top cover being forced into contact with the electric conducting elements of said IC board to turn on said IC when said top cover is pressed down; and a bottom cap covered on said casing at one side and coupled to said coupling plate, said bottom cap comprising a magnet at one side adapted for securing to a metal surface, and an endless upright flange at an opposite side, said endless upright flange being inserted into said casing, and having two opposite retainer rods respectively forced into engagement with the retaining grooves of said coupling plate, and a plurality of voice output holes matched with the voice output holes of said coupling plate.

2. The buzzer assembly of claim 1 further comprising a plurality of light emitting elements respectively mounted in respective through holes in said ornament and electrically connected to the IC of said IC board by electric wires; said top cover has at least one wire hole through which the electric wires of said light emitting elements pass.

* * * * *